United States Patent [19]

Winiecki et al.

[11] Patent Number: 4,583,183

[45] Date of Patent: Apr. 15, 1986

[54] MASKED MULTICHANNEL ANALYZER

[75] Inventors: Alan L. Winiecki, Downers Grove, Ill.; David C. Kroop, Columbia, Md.; Marilyn K. McGee, Colorado Springs, Colo.; Frank R. Lenkszus, Woodridge, Ill.

[73] Assignee: The United States of America as represented by the United States Department of Energy, Washington, D.C.

[21] Appl. No.: 469,349

[22] Filed: Feb. 24, 1983

[51] Int. Cl.[4] ..... H01J 39/34

[52] U.S. Cl. ..... 364/498; 250/281; 250/288

[58] Field of Search ..... 364/498; 250/281, 288; 340/608, 635, 660

[56] References Cited

U.S. PATENT DOCUMENTS

| | | | |
|---|---|---|---|
| 2,648,008 | 8/1953 | Sink | 250/41.9 |
| 2,662,185 | 12/1953 | Robinson et al. | 250/41.9 |
| 2,772,367 | 11/1956 | Robinson et al. | 250/41.9 |
| 2,810,075 | 10/1957 | Hall et al. | 250/41.9 |
| 3,005,911 | 10/1961 | Burhans | 250/41.9 |
| 3,012,139 | 12/1961 | Hanson et al. | 250/41.9 |
| 3,254,209 | 5/1966 | Fite et al. | 250/41.9 |
| 3,342,991 | 9/1967 | Kronenberger | 250/41.9 |
| 3,626,182 | 12/1971 | Cohen | 250/41.9 TF |
| 3,641,340 | 2/1972 | Van Der Grinten et al. | 250/41.9 G |
| 3,648,047 | 3/1972 | Bushman | 250/41.9 G |
| 3,717,809 | 2/1973 | Laukien | 364/498 X |
| 3,818,197 | 6/1974 | Piccolo et al. | 364/498 |
| 3,824,390 | 7/1974 | Magyar | 250/294 |
| 3,999,065 | 12/1976 | Briggs | 250/281 |
| 4,008,388 | 2/1977 | McLafferty et al. | 364/498 |
| 4,014,614 | 3/1977 | Sandercock | 364/498 X |
| 4,140,394 | 2/1979 | Roos | 364/498 X |
| 4,301,684 | 11/1981 | Thompson et al. | 73/602 |
| 4,318,616 | 3/1982 | Chamran et al. | 364/498 X |
| 4,365,303 | 12/1982 | Hannah et al. | 364/498 |

OTHER PUBLICATIONS

Advertisement-Biomation Model 8100 Waveform-/Recorder, Gould Inc., Biomation Division, 4600 Old Ironsides Dr., Santa Clara, CA 95050, Apr. 15, 78/8100 Br-1.

Multiple Sampling Digital Boxcar Integrator, An Efficient Signal Averager, R. Suzuki, et al., Review of Scientific Instruments 52(2), Feb. 1981, pp. 287-292.

Instruction Manual, No. 20-31-A, Rev. 1, CVC Products, Inc., Rochester, New York 14603—for Type MA-010 Output Scanner.

Advertisement for Ultra High Speed Sample/Track and Hold Amplifiers, Analog Devices, pp. 305A-308A.

Measurement of Weak Airglow Emissions with a Programmable Scanning Spectrometer, Meriwether, Jr., National Astronomy and Ionosphere Center, Planet, Space Sci., vol. 27, No. 10, Oct. 1979, pp. 1221-1232.

Microprocessor-Based Data Acquisition System for Chemiluminescence Measurements, Marino & Ingle, Jr., Anal. Chem, Jul. 1981, 53, No. 8, pp. 1175-1179.

Advertisement for Ultra High Speed A/D Converters, Analog Devices, pp. 235S-240S.

Advertisement for LeCroy Wideband Pulse Amplifier, LeCroy Research Systems, Corp., 700 S. Main Street, Spring Valley, New York 10977, pp. 119-122.

Advertisement for Fujitsu Bipolar Random Access Memory, Model MB 7072N/E, pp. 1-7.

*Primary Examiner*—Edward J. Wise

*Attorney, Agent, or Firm*—William Lohff; Walter L. Rees; Judson R. Hightower

[57] ABSTRACT

An analytical instrument and particularly a time-of-flight-mass spectrometer for processing a large number of analog signals irregularly spaced over a spectrum, with programmable masking of portions of the spectrum where signals are unlikely in order to reduce memory requirements and/or with a signal capturing assembly having a plurality of signal capturing devices fewer in number than the analog signals for use in repeated cycles within the data processing time period.

17 Claims, 10 Drawing Figures

MASKED MULTICHANNEL ANALYZER

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

This invention relates to analytical instruments with improved capacities for detecting and determining components in a complex mixture of substances, and more particularly to multichannel analytical instruments such as time-of-flight mass spectrometers with data acquisition means capable of processing a large number of signals within a limited time period. As generally illustrated in FIGS. 1 and 2, mass spectrometers are multistage evacuated devices in which vapors are bombarded with electrons to form positive or negative ions, the mass/charge ratios (m/e) of which are subsequently determined by various means. The data output is often in the form of a mass spectrum which provides a plot of intensity against mass/charge ratio as illustrated in FIG. 3. For a given substance the mass spectrum will consist of mass/charge peaks in number and relative position determined by the fragmentation pathways open to the substance molecules upon ionization. Each substance is associated with a unique set of fragmentation pathways and rate constants, and thus a unique mass spectrum will result and may be used to identify the substance.

In the use of time-of-flight mass spectrometers for sample analysis, a triggered time scan of the type illustrated in FIG. 3 is used to detect electrical signals generated within the instrument which are representative of fragment ion intensities in a mass spectrum with the time axis being converted by computation to the m/e axis of the mass spectrum. Data generated from the time scan are processed by data acquisition or signal processing means to provide a record of the relative intensities and position of the signals in the mass spectrum. The signals corresponding to m/e values are usually irregularly but predictably spaced along the time axis and, particularly for low m/e values, are about 20 nsec FWHM (full width at half maximum). For data acquisition purposes the cycle time period may be divided into a number of narrow time intervals identified as "channels", each corresponding to a position along the m/e axis of the mass spectrum. The number of channels used will vary depending on the time period for each channel and the m/e range to be covered in the mass spectrum. With channels 10 nsec wide, the number of channels needed to collect a mass spectrum over the range 1–1000 atomic mass units (amu) would be 20,000 since a 200 μsec time period would necessarily be recorded. Because the mass signals can be as short as 20 nsec FWHM, it usually is not feasible to use channels wider than 10 nsec.

Many conventional time-of-flight mass spectrometer data acquisition means have no more than four data channels. As a consequence, only one to four data points are recorded each time the complete 200 μsec signal of FIG. 3 is generated at the ion multiplier output which represents one cycle. After each cycle of the TOFMS, the data acquisition channels are moved to a new location along the time axis, relative to some trigger pulse that initiates a cycle, so that bit by bit the entire 200 μsec time period is recorded. A true representation of the output is not recorded if the ion concentrations change, as they usually will, during the time this instrument is repeatedly cycled to construct a complete spectrum. In addition to the lengthy data processing time, the large number of TOFMS cycles requires an appreciable amount of instrument time.

More recently, data acquisition means have been provided with 2048 channels to record data from a time-of-flight-mass spectrometer. When the channels are spaced in time at 10 nsec intervals, the instrument is still only capable of recording a 20 μsec (2048×10 nsec) portion of the output illustrated in FIG. 3 during one cycle. Therefore, it is necessary to repeat the process 10 times with a variable time delay triggering the data acquisition means, in order to completely record the 200 μsec long mass spectrum.

In addition to the limitations of the scanning process, othe problems with the time-of-flight-mass spectrometers have been related to the inability of the data acquisition portion of the instrument to record an individual signal of short duration at each channel and the lack of capacity to process a multiplicity of signals within a limited time. These problems have also been related to the capacity of the instrument to perform the desired function with a reasonable limit on the complexity and cost of the electronics.

One object of this invention is an analytical instrument useful for generating and detecting a large number of signals of relatively short duration and data acquisition means capable of processing those signals. A second object is an analytical instrument with data acquisition means capable of processing a large number of signals within a limited time. A third object of the invention is an analytical instrument capable of processing a plurality of predetermined signals. A fourth object of the invention is an analytical instrument characterized by a large number of analog signals generated in a single time scan within a short period and capable of processing all of the data represented by the signals within essentially one time scan. Another object of the invention is a data acquisition means in an analytical instrument capable of processing a large number of signals with limited equipment. Yet another object of the invention is data acquisition means in an analytical instrument capable of processing analog signals of a duration time less than about 50 nsec. An additional object of the invention is a time-of-flight mass spectrometer capable of generating a mass spectrum over the range 1–1000 amu or selected portions thereof. A further object of the invention is an instrument capable of summing the spectra acquired over many scans.

Additional objects, advantages and novel features of the invention will be set forth in the description which follows and in part will become apparent to those skilled in the art upon examination of the following or may be learned by practice of the invention.

SUMMARY OF THE INVENTION

Briefly, the invention is directed to two particular aspects of an analytical instrument having an internal output divided into a series of segments representing a spectrum of values and useful with analog signals which represent characteristics of an analytic sample or samples. The signals are irregularly, but predictably, spaced along the spectrum with data acquisition means being provided to process the signals from the output. In one aspect, the data acquisition means includes a memory capacity less than the number of output segments and programmable masking is provided for certain of the segments representing zones where signals are not expected in order to reduce the otherwise required memory capacity. In a second aspect, the data acquisition means includes a plurality of signal capturing means and signal conversion means each less in number than the analog signals to be recorded with means being provided to utilize the plurality of capturing means over a plurality of repeated cycles within a data processing time period.

DETAILED DESCRIPTION OF THE PREFERRED EMBODIMENT

Figure 1:
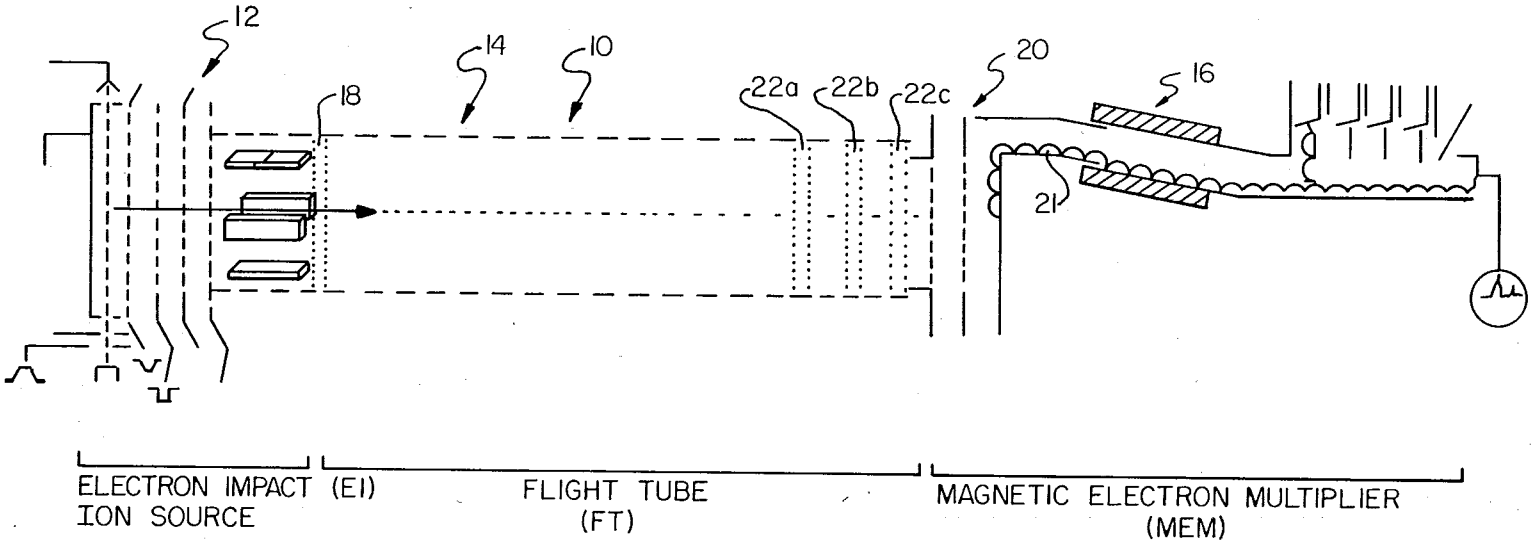
FIG. 1 is a pictorial representation of a time-of-flight mass spectrometer within the art.

The analytical instrument system of the invention includes analog signal means for providing a series of electrical analog signals irregularly but predictably spaced in time and representative of technical data from a sample or samples. Data acquisition means are provided for detecting the presence, relative position, and intensity of each of the signals along a time axis representing a spectrum of values and for processing the data related to the detected signals.

Analog signals with the described characteristics may be generated within an ion detector, an electron multiplier, a photomultiplier or similar device whose output provides information regarding the analysis or constituents of a sample. Signal generating devices of this type are used in time-of-flight mass spectrometry and may be extended to other forms of spectrometry, particularly mass spectrometers. Therefore, while the following description relating to the figures will refer to time-of-flight mass spectrometry, it is to be understood that the invention is not limited to those instruments.

In the processing of the analog signals, data acquisition means is provided to record the intensity and relative position (on the time axis) of each of the analog signals and for storing the data related to the signals. Advantageously, the data acquisition means includes multichannel means interconnected to the analog signal means and providing a plurality of electrical channels arranged in a time scanning sequence with each channel representing a position at which a signal may appear along the time axis with signal recording means being provided for recording data from at least a portion of the channels. The data acquisition means further includes programmable masking means acting in cooperation with the multichannel means prior to the signal recording means for electrically masking at least a portion of those channels corresponding to positions where the signals are unlikely to appear. In the absence of the programmable masking means, excessive equipment and time would be required to record the signals in a channel on every TOFMS cycle. Advantageously, the masking means includes means for masking channels based on a predetermined pattern of positions where signals are unlikely to appear in order to provide open channels where signals are likely to appear. The programmable masking means also advantageously includes means for changing the masking of channels based on other predetermined patterns.

As indicated above, the programmable masking reduces the number of open channels at which signals will be recorded and therefore reduces the amount of equipment including memory capacity associated with the signal recording means and required for analysis. In a short time, the data acquisition means acts to record essentially all of the signals within the desired spectrum within one cycle time of the TOFMS.

The inventive instrument is particularly useful on signals which are of a relatively short duration and difficult to process. In general, these signals have FWHM of less than about 50 nsec and are more usually in the order of 20–50 nsec. The instrument includes a source of analog signals of the type previously described, a detecting system including a series of channels arranged in a time scanning sequence and signal processing means. While the benefits provided by the unique signal processing operation are not entirely dependent on the masking of certain channels as previously described, each aspect of the invention is interrelated to reduce the amount of equipment required to process the data relating to the signals.

In the processing operation involving a further important feature of the invention, the signals are captured and held for a time sufficient for an analog-to-digital conversion means to convert the analog signals to digital signals which are then stored in TTL data memory. Since the analog signals are of short duration and have an amplitude of a meaningful value, the capturing means must be capable of capturing and holding the signal amplitude accurately until the analog-to-digital convertors act to provide the conversion. Fast track and hold devices are capable of capturing the fast signals but do not have the sufficient droop-free holding time for the conversion process (which must be completed without occurrence of signal droop). However, by combining fast track and hold devices with slower track and hold devices, this problem is overcome. Slower track and hold devices can capture slowly varying signals (such as the output of the fast track and hold devices) and hold them "droop-free" for a length of time sufficient to accommodate the analog-to-digital conversion process. In the combination, each of the signals is captured by one of a first plurality of fast track and hold devices which transmits the signal amplitude to one of a plurality of slower track and hold devices. Since the holding time of the slower track and hold devices exceeds that for the faster devices, more of the slower devices are utilized, which usually are equal to the number of analog-to-digital convertors. As the fast track and hold devices require a short time for the capturing and transmission process, a limited number of devices may be used. Advantageously, they are less in number than the analog-to-digital convertors and less than the number of signals to be recorded. In this arrangement, each of the devices is used repeatedly during the signal acquisition process.

As illustrated in FIG. 1, a time-of-flight mass spectrometer 10 includes an electron impact ionization source 12 (or other ion source), a flight tube 14 and an ion detector such as a magnetic electron multiplier 16. In general, a sheet 18 (as identified in FIG. 1) of ions of various mass-to-charge (m/e) ratios is accelerated to several kilovolts and directed through the field-free flight tube 14 region toward the ion detector 16. Since all of the ions receive equal kinetic energy, their respective drift velocities depend on their m/e ratio, i.e., the lighter (or more greatly charged) ions travel to the detector 16 faster than do the heavier (or less charged) ions as illustrated by sheets 22*a–c*. Ion velocity is proportional to $\sqrt{e/m}$ where e is the ion charge and m is the ion mass.

Because all the ions leave the starting point in the source simultaneously, and all drift a considerable distance to reach the detector 16, they will separate into individual sheets of equal m/e displaced from other sheets of different m/e. Each sheet of ions passes through grids 20 and strikes detector cathode 21, where the ions dislodge electrons. These electrons are directed by crossed electrostatic and magnetic fields into the multiplying region where the electron current is amplified. The electron current at the anode is converted to a voltage drop across a resistance and the voltage may be displayed on an oscilloscope or recorded by some means. This process is repeated at a rate of 3,000–100,000 times per second, depending on the application and the particular design used for the instrument. The peak heights for the various voltage pulses representing m/e values are linearly related to ion abundance which can be translated into species concentration.

Figure 2:
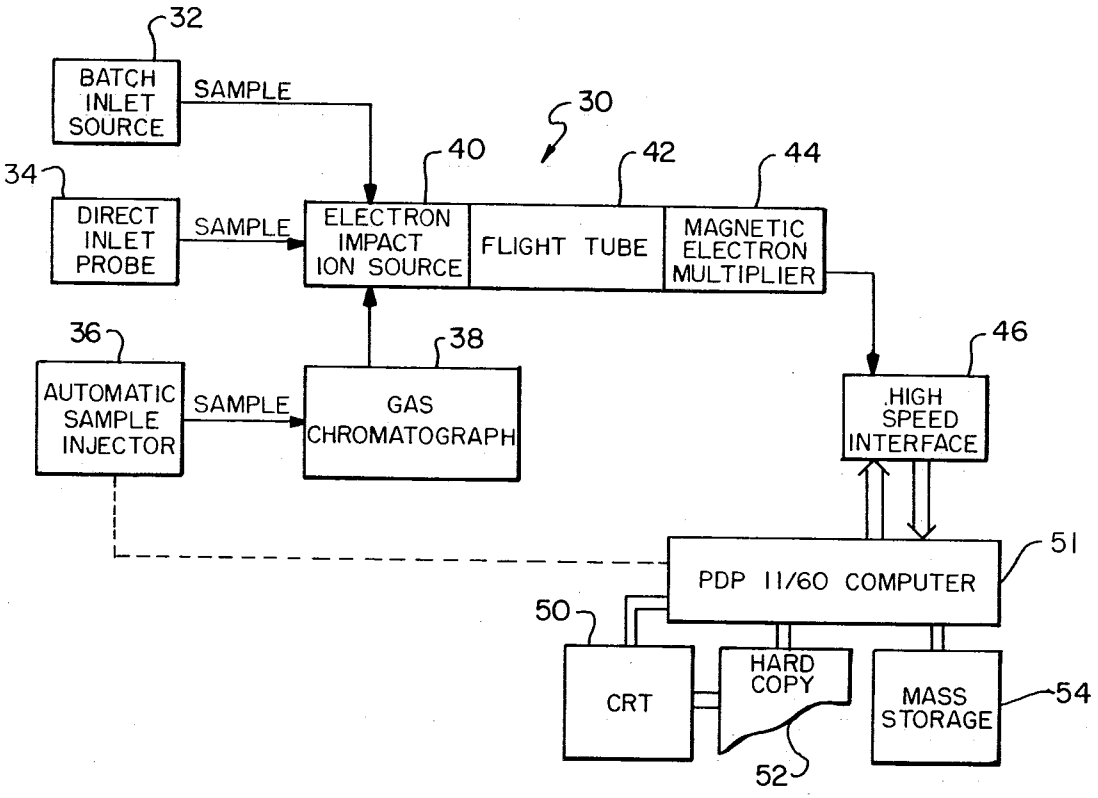
FIG. 2 is a block diagram of a representative time-of-flight mass spectrometer with associated sampling and computer equipment.

FIG. 2 provides a block diagram of a representative time-of-flight mass spectrometer 30 and the associated sampling and analytical equipment. As illustrated, samples may be provided by a batch source 32, a direct inlet probe 34, or an automatic sample injector 36 which may include the transfer of the sample through a gas chromatograph 38 into the electron impact ion source 40. The mass spectrometer 30 includes a flight tube 42 and a magnetic electron multiplier 44 as previously described. Data acquisition interface with the computer facility is provided by the masked multichannel scaler 46 with the computer 51 transferring data to a video display 50, a copying facility 52 for producing hard copies or a data storage facility 54.

Essentially, the time-of-flight mass spectrometer of particular interest is an analytical instrument which is operable over a spectrum of mass values in the order of 1–1000 and produces in one or more time scans a large number of nonlinearly spaced analog signals extending in a sequential manner along the time scan or scans with each signal representative of data at a particular mass point. The data represented by the record of the time scan are fed out of the instrument through a plurality of channels, or logic gated with a source of channels, each representing a small segment of the spectrum. In general, each signal covers a portion of the spectrum or a time zone less than about 50 nsec. in duration and more usually in the order of about 20 nsec. Accordingly, it is necessary that each channel cover a time zone of about 10–20 nsec and particularly 10 nsec for the 20 nsec signal. For a spacing of 10 nsec., about 20,000 channels or positions are available along the 200 μsec duration of the signal output typified in FIG. 3.

Figure 3:
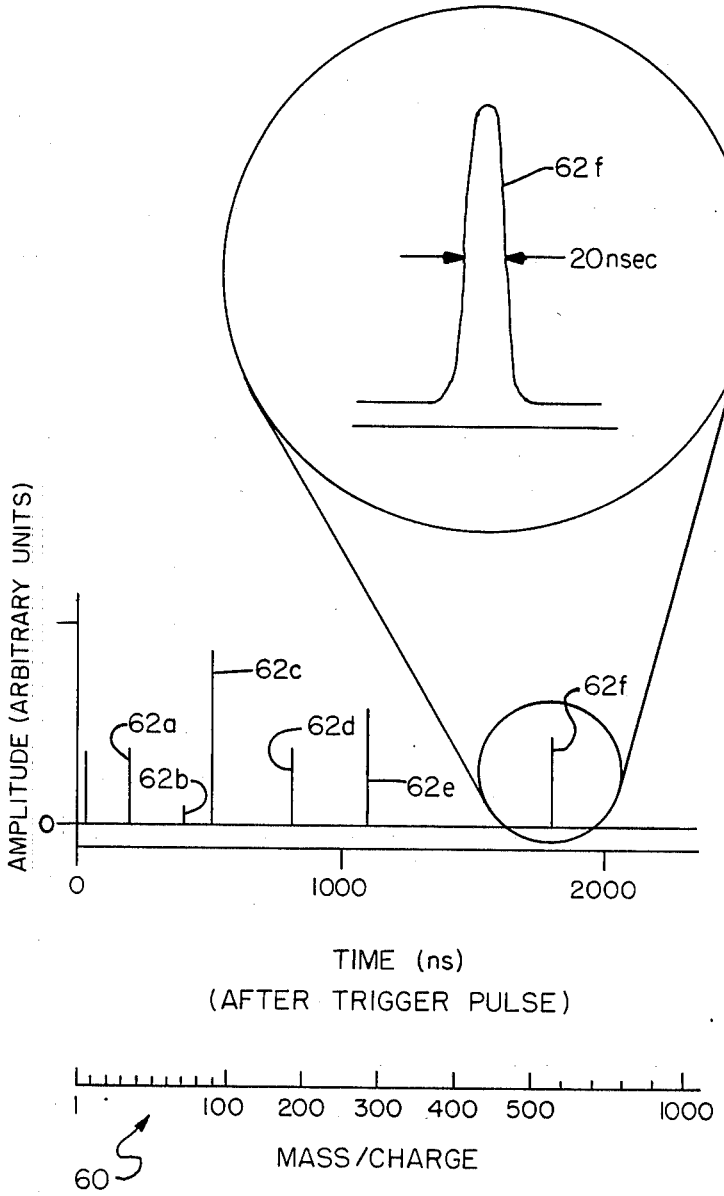
FIG. 3 is a diagram of the detector output from a time scan of a time-of-flight mass spectrometer.

FIG. 3 includes a representative time scan 60 or output from a time-of-flight mass spectrometer with the output being continuous over a time period of approximately 200 μsec following a trigger pulse. As illustrated, the output includes a plurality of fast analog signals 62*a–f* in the order of 20 nsec FWHM (full width at half maximum) distributed irregularly over the time period. Transmission of the output to the processing means is accomplished by means of a series of channels (20,000) to cover the time scan or time period with 10 nsec between channels in order to avoid missing a signal. Data from each signal include position of the signal along the time scan and its amplitude. Conventionally, it would be necessary to take readings at each of the 20,000 channels to avoid missing a signal and utilize 20,000 memory locations for recording the readings.

Figure 4:
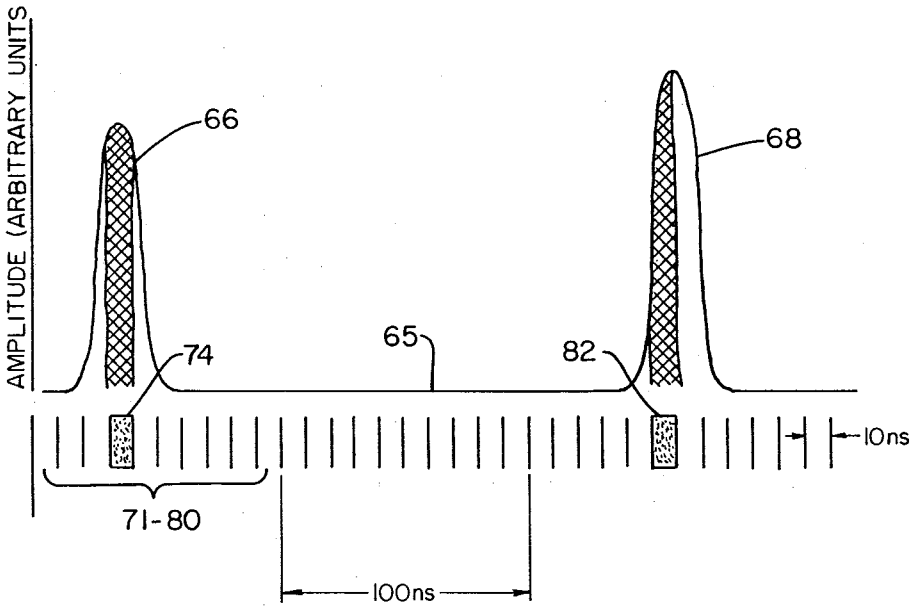
FIG. 4 is a diagram of a portion (enlarged) of the spectrum from the detector output of the time-of-flight mass spectrometer and a representation of the channels associated with that spectrum.

For the type of signal output illustrated in FIG. 3, most of the locations in the output representing portions between signals would contain no useful information. Further, it has been found that signal output of this type may be accurately recorded if only 2048 channels spaced 100 nsec apart are used, provided each channel open to transmit a signal may be independently adjusted ±50 nsec in 10 nsec increments. Therefore the data acquisition means includes masking means to mask the output so that only one channel in each 10 channels is open to transmit a signal with the position of the open channel being adjustable by the masking procedure. As illustrated in FIG. 4, a series of channels is provided to represent small segments of the signal output 65 with the channels being arranged in groups of ten. Channels 71 to 80 extend below signal 66 with channels 71–73 and 75–80 being blocked or masked while channel 74 is open. In a similar manner, channel 82 below signal 68 is kept open while the remaining nine channels in the associated 10 bit word are blocked based on a predetermined pattern. Advantageously, the masking means is programmable to accommodate one or more different patterns.

Figure 5:
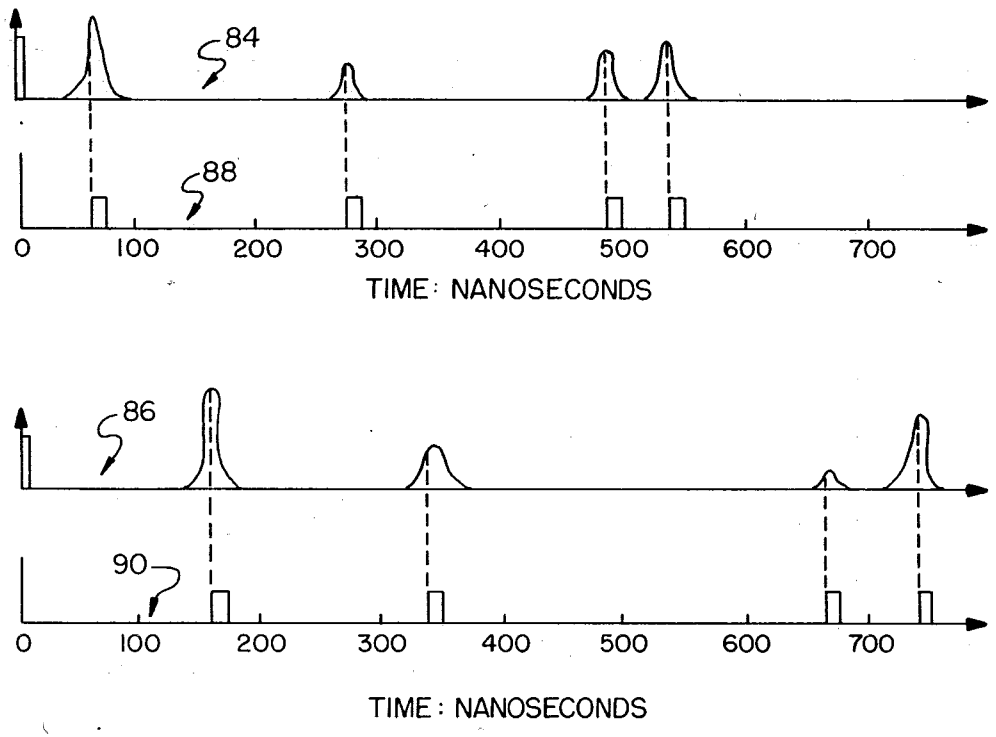
FIG. 5 is a diagram of two different spectra from the detector output illustrating the results from two different samples, and associated unblocked channels established by the ECL circuitry.

Therefore, in accordance with the invention, means are provided for masking the channels to block a predetermined pattern of channels where signals are not likely to occur. Means are also provided for remasking to provide different or subsequent patterns of open and blocked channels for various purposes. In some instances, operating conditions of the instrument are intentionally or otherwise changed, causing a change in the positions of the signals in the output which requires remasking. It also may be desirable to adjust the positions of the open channels to improve the match between the open channels and the signal pulses. As illustrated in FIG. 5, two different masks 88 and 90 are required for two different signal outputs 84 and 86. It is noted that as the signal output 84 is changed to signal output 86, the positions of the signals change and it is necessary to remask the channels to accommodate the new pattern.

The inventive instrument includes data acquisition means for carrying out the desired processing of the signals. For masking, a calibration procedure is provided for generating a predetermined pattern of channels where useful signals cannot appear. Advantageously, the output means includes a series of channels representing spectrum segments and the masking means for blocking those channels corresponding to zones where useful signals do not appear, or conversely opening those channels where useful signals may be expected to occur. In addition, the masking means includes means for remasking the output as conditions change.

Figure 6:
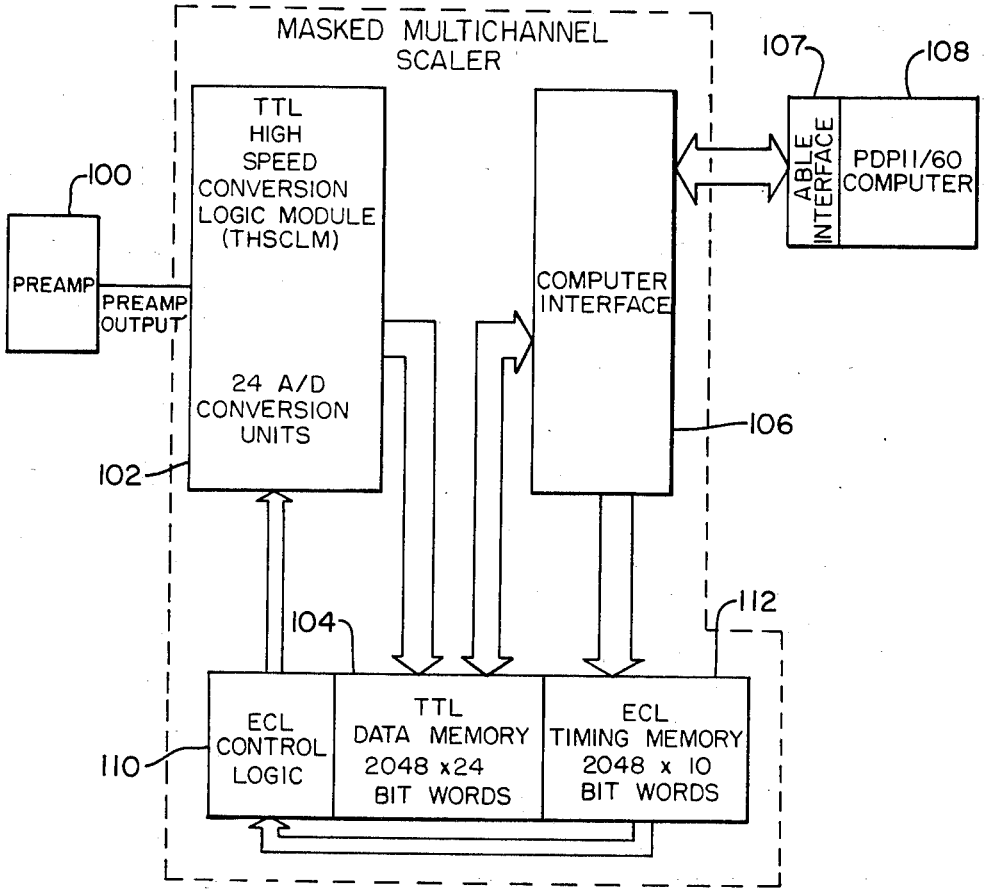
FIG. 6 is a block diagram illustrating the arrangement of components of the signal processing components of one embodiment of the invention.

For masking of the channels and as illustrated in FIG. 6, the ECL memory is important to the flexibility of the operation. Initially for each masking, a known sample and/or a series of calculations of mass positions are placed at the signal input to the conversion units 102 and the results are fed to computer 108 to provide a predetermined pattern of instructions corresponding to zones in the output where signals will not appear and zones where signals may appear. These instructions are fed to ECL memory 112 and are subsequently fed to ECL control logic 110 to mask those channels corresponding to zones where signals will not appear.

In the specifics of the masking operation, ten data acquisition cycles are run. For cycle 1, bit 0 of each ECL word is set; for cycle 2, bit 1 of each ECL word is set, and so on. At the end of the tenth cycle, the computer 108 has in storage 2,048 word vectors which are interleaved to give a 20,480 word vector. All signal pulses occurring within 200 μsec of the trigger pulse will be recorded in this vector. A search of the vector is done, and, whenever a signal is encountered, the corresponding ECL bit is set as shown in FIG. 4. When the whole vector has been checked and ECL bits are set for any desired interpolated values which, although empty for the calibration material, may contain signals of interest when other substances are analyzed, the ECL mask is completed and the calibration step is over. The ECL pattern is now stored in ECL memory 112 and the signal processing means is now ready to acquire any signals which are generated by the same means as the calibration signal. During the operation of the signal processing means, the 20,480 ECL bits are read out one after another at 10 nsec intervals corresponding to a total of $20{,}480\times 10$ nsec$=204$ μsec. When a set bit is encountered, an analog-to-digital conversion is triggered. The ECL memory 112 is loaded under program control with the restriction that only one bit may be set per ECL word. The flexibility of the signal processing means is thus provided by the programmable ECL "mask".

For converting the analog signals of the signal output to digital signals, the signal processing means includes signal capturing means and signal conversion means. Advantageously, the signal capturing means includes a plurality of signal capturing devices each capable of capturing an analog signal and holding it for conversion to a digital signal with each of the devices being used repeatedly during the processing of the signals. Switching means are also provided for switching the incoming signals from the TOFMS output to particular ones of the capturing devices which are not holding signals. Advantageously, the conversion means includes a plurality of analog to digital conversion devices each coupled to a capturing device for receiving a signal and converting it to a digital signal. In the conversion of the signals for one output, each of the signal conversion devices is used repeatedly for a plurality of incoming signals received from the signal capturing devices.

In the capturing operation, means are provided for capturing the analog signals of normally short duration and converting the analog signals to digital signals. In one embodiment of the invention, the analog-to-digital (A/D) conversion time required to accomplish the desired overall system (9.5 bit) accuracy is about 2400 nsec or 2.4 μsec. Since an analog-to-digital conversion may be achieved on the average every 100 nsec., then 24 A/D (2400/100) convertors are required.

FIG. 6 provides the electronic system for the above purposes in block form. The analog output of the electron multiplier is amplified by the preamplifier 100 and routed to 24 analog to digital conversion units 102 as shown in FIG. 6. The digital data after conversion is stored in the $2048\times 24$ bit word TTL data memory 104. At a completion of a data run; the TTL data memory contents are routed via the computer interface 106 to the computer 108 through a bus interface 107. The timing and switching required for the analog-to-digital conversion commands originates in the ECL control logic 110 which derives its information from the ECL timing memory 112.

Figure 7:
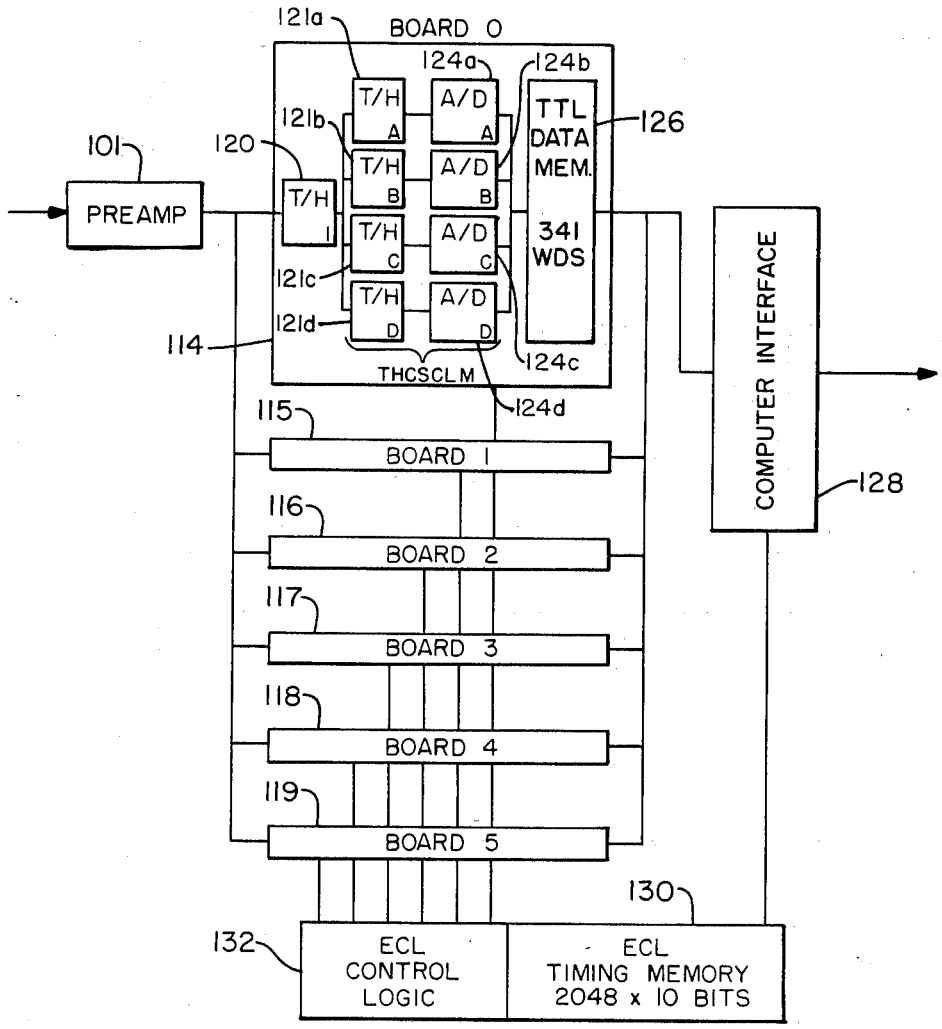
FIG. 7 is a block diagram illustrating the circuit boards and associated logic and memory for the signal capturing and signal conversion devices representing an embodiment of the invention.

As illustrated in FIG. 7, the 24 A/D convertors 102 (of FIG. 6) are located on six boards 114–119 with each board having one fast capturing means represented by a fast track and hold device 120 and a plurality of slower capturing means represented by four slower track and hold devices 121 coupled to individual A/D convertors 124 which in turn are coupled to a TTL memory 126 on each board. A computer digital interface 128 serves as an interface between each board and the computer facilities and between the ECL memory 130 and the computer facilities. Each board is essentially identical. The purpose of the capturing means is to capture each of the fast analog signals within the 10 nsec time period and hold the signal until an A/D convertor 124 may complete the conversion process. While the first capturing means represented by the fast track and hold device 120 has a high frequency response and is capable of capturing the fast signal, it is incapable of holding the voltage level long enough without voltage droop for the operation of the A/D convertor 124. Therefore it is necessary to provide the second capturing means represented by the slower track and hold devices 121 which have a lower frequency response but also a lower voltage droop rate.

To obtain the speed necessary for dynamic operation of the THSCLM, several design techniques were used. One such technique was multiplexing. The THSCLM consists of six identical boards as illustrated in FIG. 7. The signal coming to the boards is actually a train of pulses of short duration, appearing in a nonlinear manner over a time period of about 200 μsec. This input signal is routed simultaneously to all six boards. The timing signals for the THSCLM (tn, where $0\leqq n\leqq 23$), i.e. the signals that start the cycles that convert the analog pulses to digital information in the THSCLM, are multiplexed to the boards from the ECL control logic as suggested in FIG. 8.

Before being transmitted to the signal processing means, the signal from the instrument is conditioned by the fast preamplifier 101 of FIG. 7 and is then fed to one of the boards determined by the ECL control logic 132.

The signal is captured by the first track and hold device 120 on the board and then transmitted to one of the second rank of track and hold devices 121A to hold the signal long enough for the A/D convertor 124A to digitalize it. The digital value is then stored in an appropriate TTL memory location. The next signal is captured by the fast track and hold device on the next board (115) and fed to one of the slower track and hold devices on that board. For the signals 7 through 12, the process is repeated except that a different slow track and hold device is used since conversion of at least some of the earlier signals has not been completed. In this manner, six fast track and hold devices 120 and 124 slower track and hold devices 121 and A/D convertors 124 are utilized to read and store up to 2,048 voltage values selected by the ECL memory mask. Of course, no ECL bit may be set within certain 100 μsec time windows and the corresponding memory location remains empty.

Figure 8:
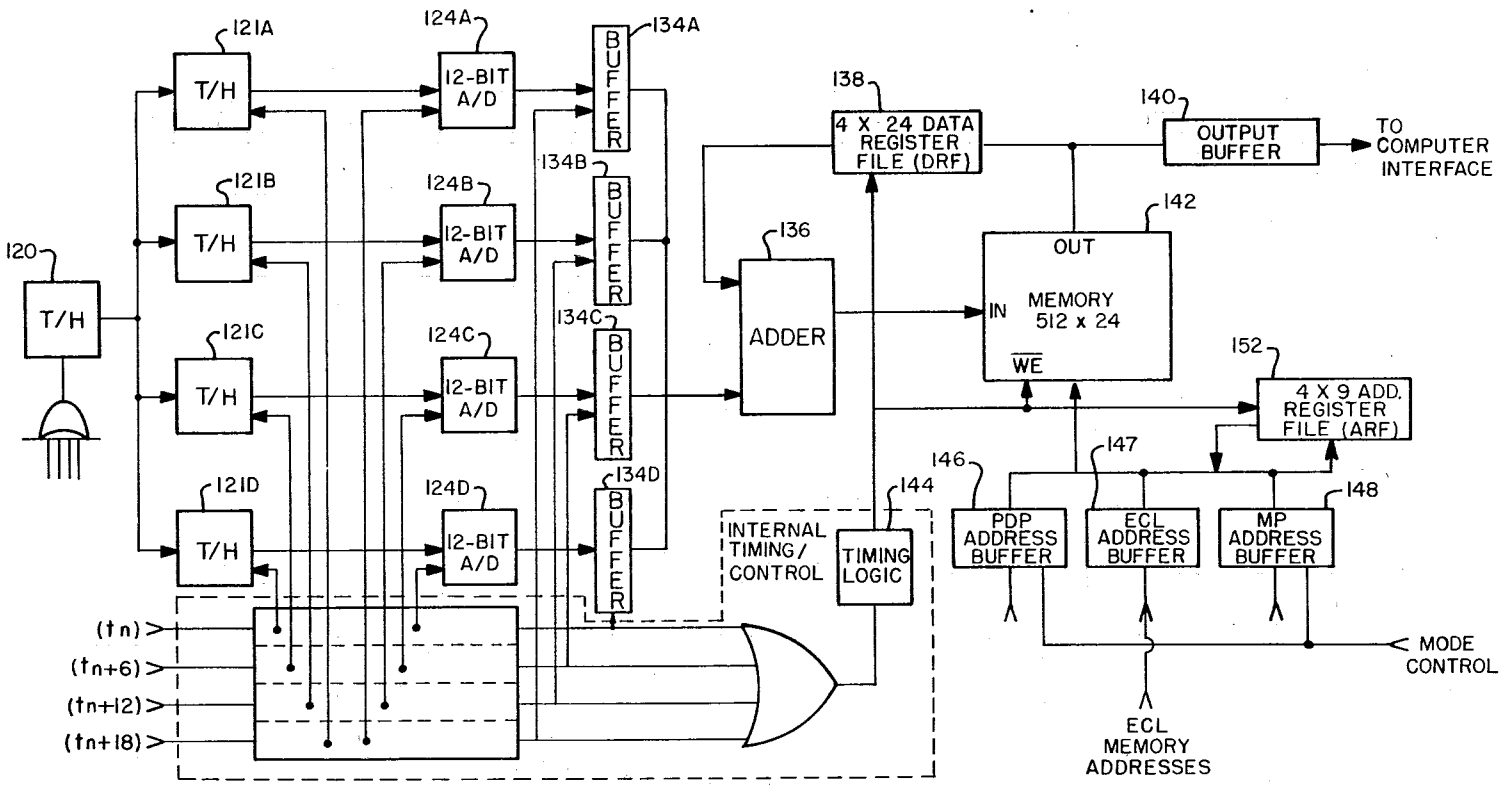
FIG. 8 is a diagram of a circuit board of FIG. 7 with greater detail on the associated TTL logic and memory system.

Further details of the signal capturing and conversion means of FIG. 7 are provided in FIG. 8 which illustrates in block form the use of buffers 134, 140, 146–148; adder 136, memory 142, registers 138, 152, A/D 124, and T/H 120, 121. With a time scan of 200 μsec., 100 conversions are possible using A/D convertors 124 with a maximum conversion time of 2.0 μsec. Since the start conversion pulses have a period of 100 nsec., 2.4 μsec will elapse before the same A/D convertor is reaccessed. This timing allows 400 nsec for any particular conversion to use the common circuitry on a board. As a unique address (location to store conversion in memory on TTL boards) accompanies each convert command within one time scan, only one 100 nsec period is allowed for use of the address bus and the address must be stored in a register. The circuitry operates in an add-to-memory mode with data from previous cycles being summed with the data from the current cycle. As illustrated, the overall system timing and its associated address are generated in the ECL timing and control logic 144. The 4×24 data register file 138 and the 4×9 address register file 152 illustrated in FIG. 8 can store four, twenty-four bit data words and four, nine bit address words, respectively. When a conversion is initiated, a unique address is associated with that conversion. The address is stored temporarily in the 4×9 address register file (ARF) 152 and the data residing in memory at that address is stored temporarily in the 4×24 data register file (DRF) 138. Thus, when the conversion is complete, it is added to the data stored in the DRF 138 associated with its unique address stored in the ARF 152. The sum is then put back into memory 142 at the unique address.

Figure 9:
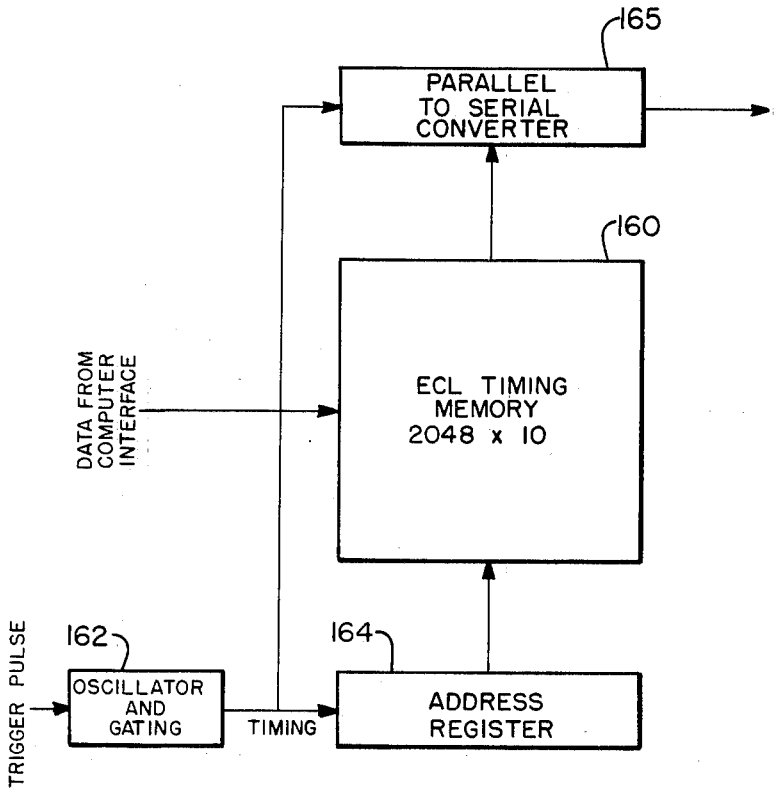
FIG. 9 is a simplified block diagram representing the ECL circuitry associated with an embodiment of the invention.

The ECL circuitry generates the time base that determines when data conversions are to occur. It receives 2,048 ten-bit words from the computer interface and sends a sampling mask consisting of a serial flow of 20,480 bits at a 100 MHz rate to the TTL high speed conversion logic modules. When synced to a trigger pulse, the relative time displacement of the serial string determines when a conversion is to occur relative to the draw-out pulse in the spectrometer. Referring to FIG. 9, the general block diagram for the ECL circuitry, data are read into the ECL timing memory 160 from the computer interface. The ECL timing memory 160 consists of 2,048 ten-bit words. After a trigger pulse is received, an oscillator 162 is gated on and timing signals that control the memory address register 164 and the parallel-to-serial convertors 165 are generated. The sampling mask output of the parallel-to-serial convertors 165 is routed to the high speed conversion logic modules.

Figure 10:
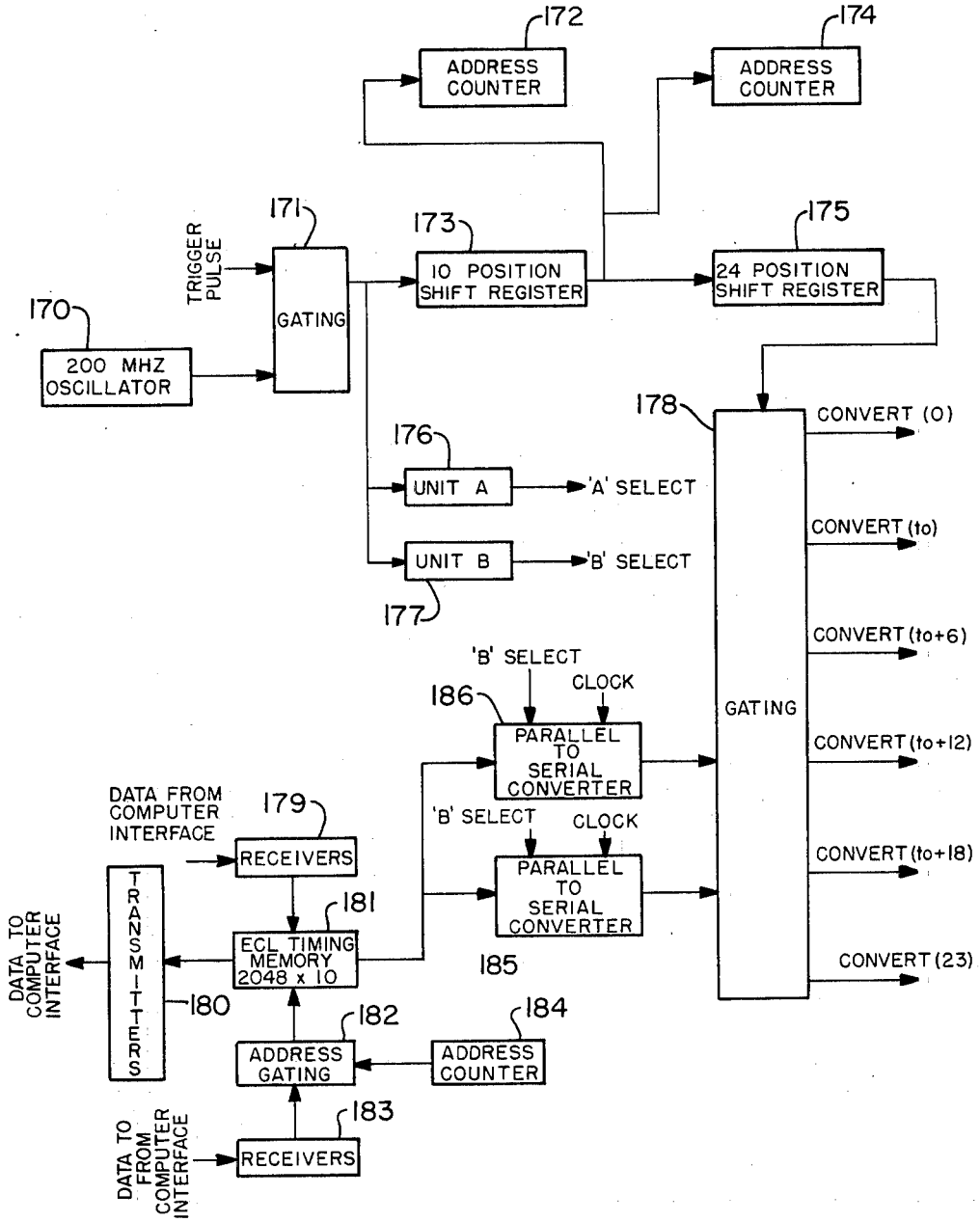
FIG. 10 is a block diagram representing the ECL circuitry of FIG. 9 in greate detail together with associated circuitry.

A more detailed explanation of the ECL circuitry is shown in FIG. 10. The ECL timing memory 181 is initially loaded from the computer interface. Data from the computer interface is routed to the ECL timing memory 181 via data receivers 179 in the form of 2,048 ten-bit words. The data are stored in the ECL timing memory 181 in addresses routed via the address receivers 183 from the computer interface through the address gating 182.

To check the data in the ECL timing memory 181, the data are routed via data transmitters 180 to the computer interface. The ECL timing memory 181 addresses are determined by addresses from the computer interface that are routed through the address gating 182 via the address receivers 183.

The data conversion and storage cycle is initiated when a trigger pulse is received by the ECL circuitry. The trigger pulse enables a 200 MHz oscillator 170 via the gating circuit 171. The oscillator 170 is used to generate the basic clock period of 10 nsec.

The sampling mask is used to command the high speed conversion modules when to do a conversion. There are 24 analog-to-digital convertors located on six boards with four convertors per board. Board 0 is hard wired to convert [0], convert [6], convert [12], and convert [18], Board 1 is hard wired to convert [1], convert [7], convert [13], and convert [19]. Board 2 is hard wired to convert [2], convert [8], convert [14], and convert [20]. Board 3 is hard wired to convert [3], convert [9], convert [15], and convert [21]. Board 4 is hard wired to convert [4], convert [10], convert [16], and convert [22]. Board 5 is hard wired to convert [5], convert [11], convert [17], and convert [23]. The 24 convert signals must have no time skew with respect to each other. Hence dual parallel-to-signal convertors 185, 186 are used. Each convert [n] signal encompasses 100 nsec of the time base. When the ECL data word for convert [n] is being gated 178 from one of the parallel-to-serial convertors 186, the other parallel-to-serial convertor 185 is being loaded with the ECL data word representing convert [n+1]. Subsequently when convert [n+1] is being gated out from parallel-to-serial convertor 185, the other parallel-to-serial convertor 186 is being loaded with convert [n+2]. While convert [23] is being gated 178, the cycle is continued with convert [0] being loaded into a parallel-to-serial convertor. The alternate routing for the parallel-to-serial convertors 185, 186 is determined by two out-of-phase 100 nsec signals named unit A 176 and unit B 177. "A-select" and "clock" cause the unit A parallel-to-serial convertor 186 to serially dump its data and "B-select" and "clock" cause the unit B parallel-to-serial convertor 185 to serially dump its data. The routing of the two outputs of the parallel-to-serial convertors 185, 186 is controlled by a 24-position shift register 175. The 24-position shift register 175 has a cycle time of 2400 nsec and consists of 100 nsec on and 2300 nsec off. It is clocked by a 100 nsec pulse that is derived from the "clock" and processed in the ten-position shift register 173. The ten-position shift register 173 has a cycle time of 100 nsec and is clocked by a 10 nsec signal. It is on for 10 nsec and off for 90 nsec.

The unit A 176 and unit B 177 shift registers have a cycle time of 200 nsec, with an on of 100 nsec and an off of 100 nsec, and are out-of-phase with respect to each other and are clocked by a common 10 nsec clock.

During data acquisition, the ECL timing memory 181 is addressed via the address gating 182 from the address counter 184. The address counter 184 is a incremented every 100 nsec by a signal derived from the "clock".

When a conversion is to take place, it is necessary to tell the high speed conversion logic modules when to make the conversion and where to store the data. Two board address counters 172, 174 supply the addresses to the logic modules. Convert [0] is on logic board 0, convert [1] is on logic board 1, convert [2] is on logic board 2, convert [3] is on logic board 3, convert [4] is on logic board 4, convert [5] is on logic board 5, convert [6] is on logic board 0, etc. Hence, when convert [0] is being serialized, the even board address counter 172 is supplying the ECL memory address to the even boards 0, 2 and 4. During this time, the odd board address counter 174 is supplying the same address to the odd boards 1, 3 and 5. When convert [5] is being serialized, the odd board 5 receives its ECL memory address from the odd board address counter 174. During this time the even board address counter 172 is incremented so that the address will be stable when convert [6] is being serialized and fed to even board 0. The process repeats for the counters every 600 nsec, the clocking pulse being generated in a divide by 6 circuit.

The embodiments of the invention in which an exclusive property or privilege is claimed are defined as follows:

1. An analytical instrument comprising analog signal means for providing a number of electrical analog signals irregularly spaced in time and representative of technical data with respect to a sample, data acquisition means for providing a time scan for determining the presence and relative position of each of said signals along a time axis corresponding to a spectrum of said technical data and for processing data related to said signals, said data acquisition means including multichannel means interconnected to the analog signal means for providing a plurality of electrical channels arranged in a time scanning sequence with each channel representing a position along said time axis, the number of channels exceeding the number of said signals, signal recording means arranged for recording data from at least a portion of said channels, and programmable masking means acting in cooperation with the multichannel means prior to said signal recording means for electrically masking at least a portion of those of said channels corresponding to positions where said signals are unlikely to appear to reduce the data processing requirements otherwise associated with the output from the masked channels.

2. The instrument of claim 1 wherein the masking means includes means for masking the channels based on a predetermined pattern of positions where signals are unlikely.

3. The instrument of claim 2 wherein the masking means includes means for changing the masking of channels based on subsequent patterns.

4. The instrument of claim 1 wherein said signal recording means includes memory means having a storage capacity sufficient for said signals but less than the total number of said plurality of channels.

5. The instrument of claim 4 wherein said signal recording means includes signal capturing means for time capturing and holding the signals received from the unmasked channels.

6. The instrument of claim 5 wherein said signal capturing means includes a plurality of signal capturing devices and switching means for switching different signals to different devices.

7. The instrument of claim 6 wherein said analog signal means provides said signals over a short time scan of less than about 200 μsec, and said signal recording means is operative to record essentially all of said signals within said time scan.

8. The instrument of claim 7 wherein said signal recording means includes means for converting the captured analog signals to digital signals for transmission to said memory means.

9. The instrument of claim 6 wherein said signal capturing devices include a first plurality of fast track and hold devices for receiving said signals from said unmasked channels and a second plurality of slower track and hold devices electrically coupled to said first plurality of devices for holding said signals beyond the holding time for said devices of said first plurality, each of said pluralities being less than the number of said signals so that at least a portion of the fast track and hold devices may be used repeatedly during one time scan.

10. The instrument of claim 9 wherein said second plurality of slower track and hold devices are coupled between said first plurality of devices and conversion means for converting the captured analog signals to digital signals.

11. The instrument of claim 10 wherein said conversion means includes a plurality of analog to digital convertors equal to said second plurality of track and hold devices.

12. The instrument of claim 11 wherein said masking means includes means for periodically predetermining channels for masking as said spectrum is shifted.

13. An analytical instrument comprising analog signal means for providing a large number of analog signals over a short time scan of less than about 200 μsec., said signals being irregularly spaced along a time axis and representing technical data with respect to a sample, the time axis representing a spectrum of said technical data greater in number than said signals, and data acquisition means for providing a time scan for determining the presence and relative position of each of said signals along said time axis, said data acquisition means including multichannel means for providing a plurality of electrical channels arranged in a time scanning sequence and signal recording means for recording said analog signals to provide a record of the presence and relative position of said signals within said time axis, said signal recording means including a plurality of signal capturing means less than the number of said signals and being operative to record essentially all of said signals within said time scan.

14. The instrument of claim 13 wherein said signals have a duration time of less than about 50 nsec. and said signal recording means includes conversion means for converting said analog signals to digital signals and memory means for storing said signals.

15. The instrument of claim 14 wherein said signal capturing means includes a first plurality of fast track and hold devices for receiving said signals from said channels and a second plurality of slower track and hold devices coupled to said conversion means, each of said pluralities being less than the number of said signals, the second devices being divided into groups each coupled in parallel to one of said fast track and hold devices and means for switching a signal from said one fast and hold device to any of said slower track and hold devices within one of said groups.

16. The instrument of claim 15 wherein said conversion means includes a plurality of analog to digital convertors equal to said plurality of slower track and hold devices.

17. The instrument of claim 16 including programmable masking means for masking at least a portion of these of said channels where said signals are unlikely to appear.

* * * * *